United States Patent [19]

Ronnkvist

[11] 4,432,662

[45] Feb. 21, 1984

[54] COMPOSITE SUCKER ROD AND METHOD OF MANUFACTURING SAME

[76] Inventor: Ake E. Ronnkvist, 4484 W. Arm Rd., Spring Park, Minn. 55384

[21] Appl. No.: 292,636

[22] Filed: Aug. 13, 1981

[51] Int. Cl.[3] ..... F16B 11/00

[52] U.S. Cl. ..... 403/271; 403/343; 228/113

[58] Field of Search ..... 403/270, 271, 343, 12, 403/299, 287; 228/2, 173 R, 173 E, 173 F, 173 B, 112, 113, 114

[56] References Cited

U.S. PATENT DOCUMENTS

| | | | |
|---|---|---|---|
| 1,538,093 | 5/1925 | Dale | 403/287 |
| 1,753,638 | 4/1930 | Axtell | 403/271 X |
| 1,907,522 | 5/1933 | Eaton | 403/292 X |
| 2,257,335 | 9/1941 | Evans et al. | 228/173 F X |
| 3,269,002 | 8/1966 | Hollander et al. | 228/2 X |
| 3,916,518 | 11/1975 | Jones et al. | 228/113 X |
| 4,096,787 | 6/1978 | Sanday | 403/271 X |

*Primary Examiner*—Andrew V. Kundrat

*Attorney, Agent, or Firm*—Peterson, Palmatier, Sturm, Sjoquist & Baker, Ltd.

[57] ABSTRACT

A sucker rod is composed of three initially separate parts comprising a relatively long body member and duplicate relatively short pin members. Upsetting steps are performed on the relatively long body member, whereas only machining steps are employed in making the pin members. One end of each pin member is inertia welded to each end of the body member after the various ends have been cut or ground to provide relatively smooth surfaces.

10 Claims, 6 Drawing Figures

COMPOSITE SUCKER ROD AND METHOD OF MANUFACTURING SAME

BACKGROUND OF THE INVENTION

1. Field of the Invention

This invention relates generally to the sucker rod pumping of oil wells, and pertains more particularly to a composite sucker rod and the method of manufacturing such a rod.

2. Description of the Prior Art

Sucker rods have been used for many years in oil well pumping. In this regard, a series of sucker rods, when coupled together, form a string that transmits power from the surface or prime mover apparatus downwardly to the recessed reciprocal pump at the bottom of the well casing.

The American Petroleum Institute has published certain standards and sizes to be adhered to in the manufacture of sucker rods. For instance, the length is specified as being 25 feet. Various rod diameters are also set forth in the API's specifications, as well as other correlated dimensional criteria or data.

In addition, various machining, finishing and allowable tolerances are specified. Still further, while the API refers to, and allows, sucker rods to be produced with an externally threaded pin at one end and an internally threaded box at the other, in actual practice sucker rods with externally threaded pins at both ends are more commonly used in the field, a separate internally threaded coupling being used to connect the various ends of the individual sucker rods into a string of such rods having a length depending upon the depth of the oil well.

In fabricating sucker rods with pins at both ends, it has become common practice to upset the ends of a section of relatively long bar or rod stock to form a bead, a wrench square, a pin shoulder, and an end stub portion of sufficient diameter extending axially from the shoulder so that the threads and neck can be machined thereon to form a finished pin at each end of the completed sucker rod.

Basically, the method that has been heretofore used to make a sucker rod utilizes a number of upsetting steps, the steps being performed sequentially with a set of appropriately configured dies so that the resulting sucker rod has the desired shape at each end. Customarily, seven upsetting steps are performed at one end, and then the seven steps repeated at the other end in order to produce the desired shape. While the rod stock can be initially heated to the proper forging temperature, usually in an induction furnace, the lack of any appreciable mass in the rod stock results in a relatively rapid cooling down of the particular end undergoing the upsetting steps. This has necessitated at least one reheating of the end being worked on in order to complete the upsetting procedure for that end.

SUMMARY OF THE INVENTION

A general object of my invention is to greatly simplify the manufacture of sucker rods, thereby enabling an appreciable cost reduction to be realized, yet at the same time adhering to the various regulations promulgated by API.

A more specific object is to reduce the number of upsetting steps required in the making of a sucker rod. Concomitantly, it is within the purview of the invention to subject each end of the rod stock to only one furnace heat, the single heating step being adequate in view of the lesser number of upsetting steps.

Another object of the invention is to facilitate the handling of the material or stock during fabrication of the sucker rod. Not only is but one heating operation needed for each end, but when practicing my invention the threads required on each pin are machined on a relatively small part in contradistinction to being machined on a relatively large part as in the past. It will be seen that it is considerably easier to chuck a small part for rotation as distinguished from rotating a relatively long or large part, as when the sucker rod is made entirely from a single piece of rod stock. Actually, my invention obviates the need for rotating the body or major portion of the partially completed sucker rod at any stage of its manufacture.

Another important object is to permit the pins at each end of a sucker rod to be made of steel having a different composition from that of the body or major portion of the sucker rod. Stated in greater detail, an aim of my invention is to provide a sucker rod of composite construction, actually composed of three separate parts or sections that are secured together by inertia welding. For example, the body or major portion of the sucker rod may be of carbon steel and the pins at opposite ends thereof of an alloy steel. Obviously, there are various grades of carbon steel and various grades of alloy steel. Hence, the sucker rod, when fabricated in accordance with the teachings of my invention, can be composed of different grades of carbon steel, different grades of alloy steel, or a mixture of carbon steel and alloy steel, as already mentioned. Consequently, my invention is exceedingly versatile, permitting a number of choices or combinations to be made as to the composition of the final sucker rod that best suits the particular pump installation with which the particular sucker rod (or sucker rods) is to be employed.

Yet another object of the invention is to provide a sucker rod that will be longlasting, particularly with respect to the threads on the pins at opposite ends thereof. It should be borne in mind that the threaded pins must be coupled together and sometimes uncoupled where the sucker rods are to be transferred to another oil well. Frequent coupling and uncoupling can cause a wearing away and mutilation of the threads. Thus, to assure longevity of the threads, an appropriate alloy can be used for each pin, whereas ordinary carbon steel can be used for the major or body portion of the completed sucker rod.

Briefly, my invention envisages the making of a unitary sucker rod from three individual pieces or parts. In this regard, it is planned that only two of the upsetting steps heretofore used be employed, the two steps being performed on a relatively long section of rod stock, and only two such steps being duplicated at the other end of this same piece of rod stock. The second and third pieces or parts, which are from relatively short rod stock but of larger diameter, that are to form the pins at opposite ends of the sucker rod when completed are machined, there being no forging steps required in their fabrication.

More specifically, it is intended that the smaller diameter and relatively long rod stock be first upset to form an enlarged cylindrical end, the second upsetting step forming a tear-shaped bead portion, a wrench portion with quadrantly located flats and a cylindrical shoulder portion. The two steps are repeated at the other end.

Thus, the duplicated bead, wrench and shoulder portions that have been mentioned are integral with each end of the intermediate rod portion of the sucker rod, the intermediate portion remaining unchanged.

The pin at each end is formed from a much shorter blank or section of rod stock having a larger diameter than that of the above-described rod stock, actually having a diameter corresponding to that of the shoulder portion referred to above. The shorter rod stock is machined to form a threaded portion and a neck portion, leaving an unmachined cylindrical shoulder portion having the diameter of the rod stock from which the threads and neck are machined.

It is imperative that each cylindrical shoulder portion be cut or ground to provide a perpendicular smooth face with respect to the longitudinal axis of the body section and each of the two pin sections, as the case may be. With the smooth faces provided, then each of the two sections, which are comparatively small, are successively chucked and rotated rapidly while the body section is held stationary. The first pin section, while being rapidly rotated, is axially advanced to cause frictional engagement of its flat face with the flat face at one end of the body section to effect an inertia weld that secures that particular pin section in place. The steps are repeated for the second pin section in securing it to the other end of the body section.

DESCRIPTION OF THE PREFERRED EMBODIMENT

Figure 1:
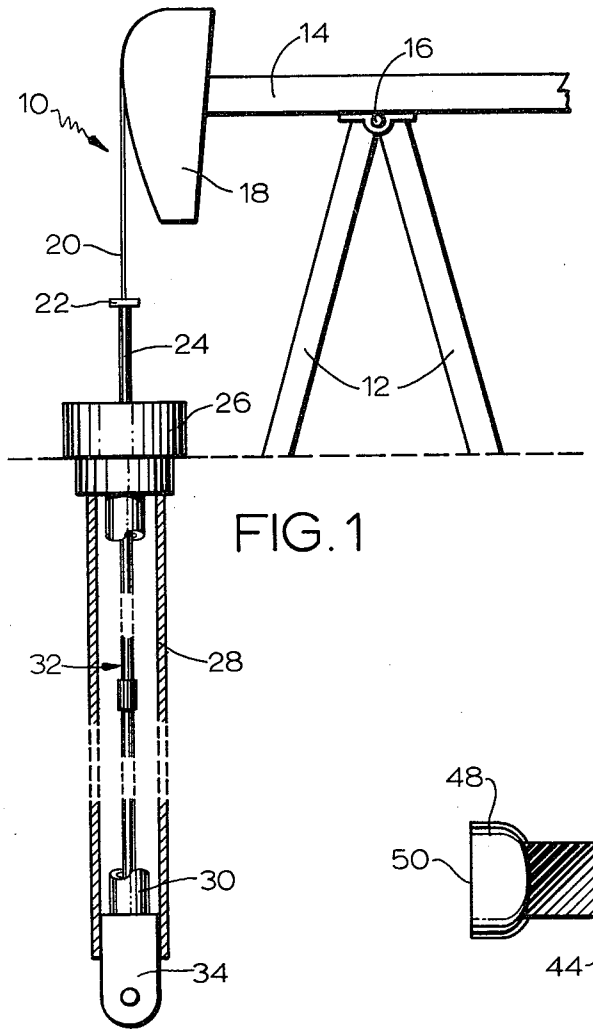
FIG. 1 is a highly diagrammatic view of sucker rod pumping apparatus utilizing my invention, the apparatus being only fragmentarily depicted.

Although perhaps not necessary to show the apparatus of FIG. 1 in that it represents conventional pumping equipment, nonetheless it is believed that reference to certain parts or components thereof will assist in appreciating the benefits to be derived from a practicing of my invention. It will be understood, however, that the sucker rod pumping apparatus which has been denoted generally by the reference numeral 10 is only fragmentarily shown. In this regard, angled supporting posts 12 have at the upper end thereof a pivotally mounted walking beam 14 which is oscillated about a horizontal pivot 16 at the top of the angled posts. The right end of the walking beam 14 has not been illustrated, but it will be appreciated that it is acted upon via the usual Pitman arm and the prime mover mechanically associated therewith that transmits the oscillatory power to the beam 14. At the left end of the walking beam 14 is what is conventionally called a horse head 18, a bridle 20 extending downwardly to a rod clamp 22 that is attached to the upper end of a so-called polished rod 24. The polished rod 24 extends downwardly into a casing head 26, the cylindrical casing 28 that extends downwardly into the well that contains therein the tubing 30 and sucker rod string indicated generally by the reference numeral 32. At the bottom end of the sucker rod string 32 is a reciprocal pump 34. All of the foregoing is concerned with what is conventional and widely used in extracting oil from scattered oil wells.

My invention is concerned with the manufacture of a composite sucker rod 36 which is fabricated from three individual parts rather than from a single unitary part as heretofore. An appropriate length of rod stock can be used and one of the advantages of my invention is that there is required only one heating step or operation for each end.

Figure 2:
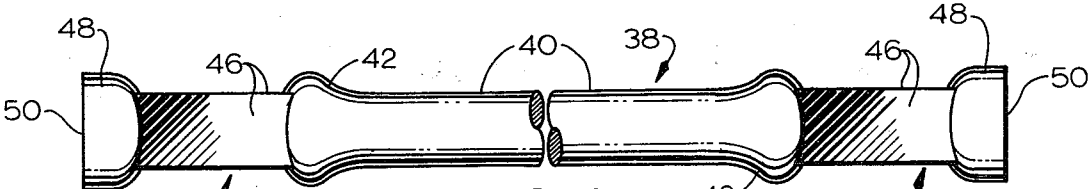
FIG. 2 is a side view of the body section of a sucker rod in accordance with my invention after certain upsetting forging steps have been performed on the end portions thereof, a substantial intermediate portion having been removed in order to permit a larger drawing scale than would otherwise be possible.

Perhaps it will be well at this stage to refer to FIG. 2 in which the body member or major part of the sucker rod has been depicted, the body member being generally identified by the reference numeral 38. In this regard, it will be discerned that the central rod portion labeled 40, which has the same diameter as the rod stock selected, has a mid-portion thereof removed in the drawing because of space limitations. It will be observed that the opposite ends of the rod portion have a bead portion 42 that is forged thereon, and integral with the bead portion 42 in each instance is a wrench portion 44 having quadrantly disposed flats 46 thereon. Next, it will be noted that each wrench portion 42 has forged thereon a cylindrical shoulder portion 48. However, the first upsetting step produces a cylindrical stub having a diameter corresponding to that of the shoulder portion 48. The second upsetting step produces the portions 42, 44 and 48.

The bead portions 42, wrench portions 44 and shoulder portions 48 are formed by only the two upsetting steps mentioned above. However, it is important when utilizing the teachings of my invention to provide flat perpendicular faces 50 on the two shoulder portions 48, there being one at each end. These faces 50 can be readily cut or ground, although it is not important that they be completely smooth; it is important that the faces 50 be perpendicular to the longitudinal axis of the rod portion 40, however.

Figure 3:
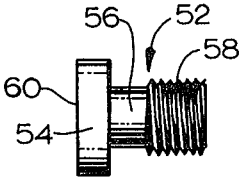
FIG. 3 is a side view of a pin member formed from a cylindrical blank or short piece of rod stock of larger diameter having a neck and threads machined thereon.

As far as the pin member 52 of FIG. 3 is concerned, it will be observed that it has a cylindrical shoulder portion 54 with a reduced diameter neck portion 56 projecting from one side thereof. Integral with the neck portion 56 is a threaded portion 58 that is machined from the original blank.

It should be made manifest at this stage that the pin member 52 is formed from a cylindrical blank or short section of rod stock of larger diameter than the rod stock from which the body member 38 is fabricated. In this regard, the rod stock from which the pin 52 is machined would have a diameter corresponding to that of the shoulder portion 48 on the member 38. In other words, the shoulder portion 54 has the same diameter as the shoulder portion 48.

Inasmuch as it is common practice nowadays to utilize a pin at each end of the sucker rod, it can be explained that there are initially two duplicate cylindrical pin blanks provided and that there are two resulting machined pin members 52 formed therefrom. Here again, the cylindrical shoulder portion 54 is formed with a relatively smooth face 60 that resides in a plane perpendicular to the longitudinal axis of the pin member 52. The rod stock used in making the pins 52 will be typically on the order of $1\frac{1}{4}$ inch diameter, actually corresponding to that of the cylindrical shoulder 54. The larger diameter rod stock is cut, as by sawing, to provide blanks having two inch lengths. The sawing will automatically produce two flat faces, the face labeled 60 being the one that is used in a manner presently explained.

Figure 4:
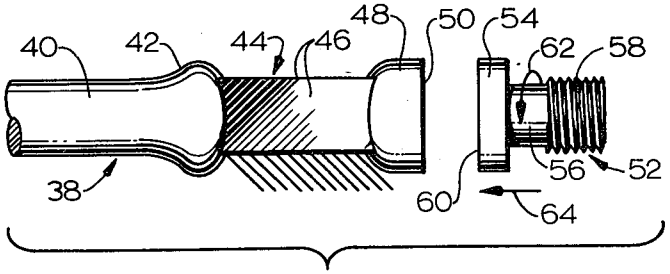
FIG. 4 is an exploded view of one end portion of the body section depicted in FIG. 2 which is held stationary while the threaded pin of FIG. 3 is rotated just prior to effecting an inertia weld.

While sucker rods can vary as to cross section, usually from $\frac{1}{2}$ to $1\frac{1}{4}$ inch diameter in $\frac{1}{8}$ inch increments, the API specifies that they have a 25 foot length. Therefore, the body member 38 is quite long, almost the 25 feet that is standard for the completed sucker rod. One of the advantages of my invention is that this relatively long body member 38 need not be rotated in the fabrication of my sucker rod 36. To machine threads on a long rod, as done in the past, is more difficult, particularly with respect to maintaining close tolerances. Actually, it is planned that it be held fixed, as generally illustrated in FIG. 4. The clamping mechanism can be of conventional construction, so only the hatching denoting a fixed mounting of the body member 38 is shown in FIG. 4.

To the right of the body member 38 in FIG. 4 is one machined pin member 52. It is to be borne in mind that the two faces 50, 60 reside in virtually parallel planes with respect to each other, owing to the fact that the face 50 is cut or ground perpendicularly to the longitudinal axis of the body member 38, whereas the face 60 is similarly cut or ground (the sawing of the rod stock into two inch lengths normally providing a usable face 60) so as to reside perpendicularly to the longitudinal axis of the machined pin member 52.

The machined pin member 52 is inserted in the chuck (not illustrated) of the equivalent of a lathe (also not illustrated) so that it can be rotated at a relatively high speed as denoted or indicated by the arrow 62. The chuck is supported on a carriage (not shown either) that can be rapidly moved in the direction of the second arrow 64 in FIG. 5. In this way, after the pin 52 has been brought up to a high rotative speed as indicated by the arrow 62, it is axially advanced in the direction of the arrow 64 so as to frictionally press the face 60 on the cylindrical shoulder portion 54 of the pin 52 against the face 50 on the stationary shoulder 48 of the body member 38. This type of technique is referred to as inertia welding, producing a very good bond and permanent securement of the two members 38, 52 together.

Figure 5:
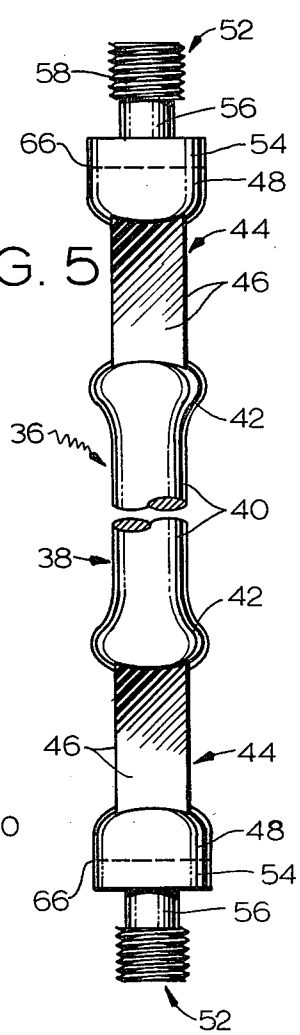
FIG. 5 is a view of a completed sucker rod oriented vertically as it is employed in the apparatus schematically portrayed in FIG. 1.

After one pin member 52 has been inertia welded to the one end of the member 38, as described above, then what is shown in FIG. 4 is repeated with the second pin member 52 which is of identical construction to the first. In this way, both ends of the body member 38 have pin members 52 welded thereto to provide the completed sucker rod 36 exemplifying my invention, as illustrated in FIG. 5. The plane of the resulting weld is indicated in phantom by the reference numeral 66, both with respect to the upper pin 52 and also with respect to the lower pin 52. It should be appreciated that the welds 66 are made where the cross section of the sucker rod 36 is the greatest (typically $1\frac{1}{4}$ inch diameter), thereby assuring a strong weld in each instance as well as distributing the load over a greater area than would result if done where the cross section is less (typically $\frac{5}{8}$ inch diameter), such as somewhere along the central rod portion 40.

It is important to appreciate that not only is the number of upsetting steps for each end of the sucker rod 36 reduced to only two, but any reheating thereof during the upsetting procedure is obviated. More specifically, where a large number of upsetting steps, on the order of seven, are required for each end of a conventional sucker rod when formed from a single piece of rod stock, when using the composite construction to produce the rod 36 of my invention, the upsetting steps that are needed to first provide a cylindrical stub portion and then to the bead portion 42, the wrench portion 44 and the cylindrical shoulder portion 48 can be quickly performed without interruption for a second heat that has been required in the past to maintain the proper forging heat.

Of definite advantage is the fact that the pin member 52 can be of different steel from that constituting the body member 38. Thus, the body member 38 can be, say, of carbon steel and each pin member 52 can be of alloy steel. Frequently, an alloy steel is desirable in the construction of a sucker rod because the threads will then last longer. However, where the entire sucker rod, as in the past, must be of the more expensive alloy steel, then the overall cost of the completed sucker rod is increased. With my invention, though, the most expensive alloy steel need only be used for a relatively small portion of the overall sucker rod 36. Thus, the pin members 52, which have a length on the order of only two inches or so, can be of an alloy steel, yet very effectively welded to the lower cost carbon steel than can constitute the body member 38.

Additionally, the threads 58 can be more readily formed on a small part, being only on the order of two inches in length, rather than on a relatively long single piece, as done previously.

Figure 6:
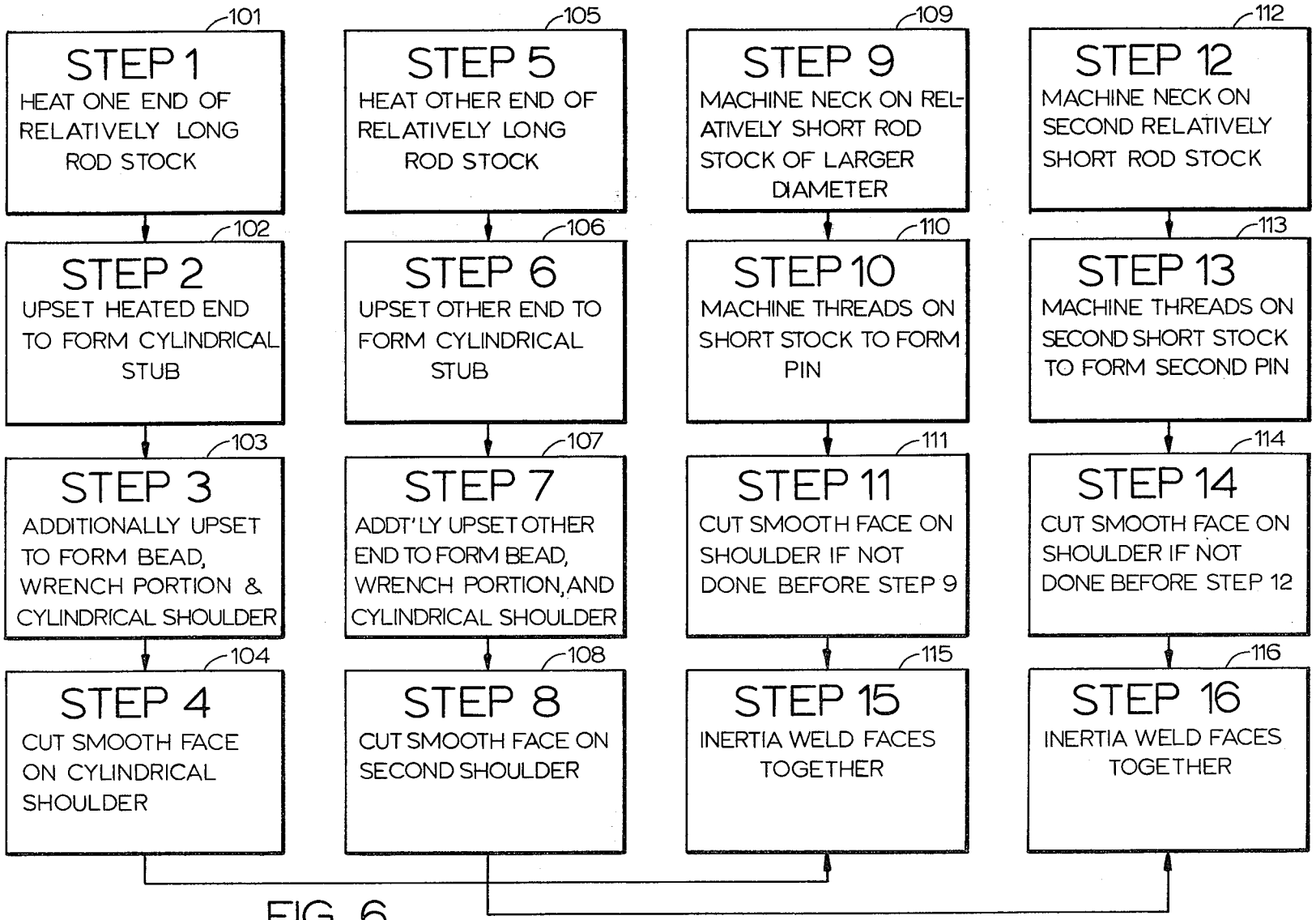
FIG. 6 is a flow diagram illustrating one manner of carrying out my manufacturing process.

Having given the foregoing information, the steps that are embodied in my invention are set forth in the flow diagram appearing in FIG. 6. While the steps are depicted in a parallel relationship with each other, it will be understood that the steps can be performed in various sequences and at various times.

At any rate, typically, one would inductively heat one end of a relatively long section of rod stock as indicated in the first step labeled 101 in FIG. 2. Next, the heated end is upset to form a cylindrical slug thereon having a diameter corresponding to the desired diameter of the shoulder 48; this second step has been assigned the reference numeral 102 in FIG. 6. The third step, labeled 103, constitutes another upsetting step forming the portions 42, 44 and the portion 48. Step four, indicated by the reference numeral 104, entails the cutting of one smooth face 50 on the cylindrical shoulder portion 48 resulting from step 102.

For the sake of keeping the description simple and straightforward, it will be considered that step #1, (101), #2 (102) and #3 (103) and #4 (104) are repeated; however, these are indicated as steps #5, #6, #7 and #8, and have been assigned the reference numerals 105, 106, 107 and 108 respectively. After the completion of steps 1–8, the fabricator ends up with the body member 38 as illustrated in FIG. 3.

Although the making of the pin member 52 can be accomplished either before or after the making of the body member 38, it will be assumed that one pin member 52 is made by means of step #9, labeled 109, deals with the machining of the neck 56 and step #10, labeled 110, which machines the threads 58, thereby completing the machining of the pin member 52 as it appears in FIG. 3. Next, which is step #11 and denoted by the reference numeral 111, the relatively smooth disk-like face identified by the reference numeral 60 is cut on the pin member 52; usually this face 60 will be formed when sawing the larger diameter rod stock into two inch lengths in making the cylindrical blanks from which the pin members 52 are machined.

Steps 9 (109), 10 (110) and 11 (111) are repeated for the second pin member 52. These additional steps forming the second pin member 52 have been identified as steps #12, #13 and #14, and have been indicated by the reference numerals 112, 113 and 114, respectively.

Assuming now that steps 1–14 (101–114) have been completed, step #15, labeled 115, is performed. In this regard, the two smooth or cut faces 50, 60 are brought together, the pin member 52 being rapidly rotated as indicated by the arrow 62 in FIG. 4 and then axially advanced as indicated by the arrow 64 to effect the inertia welding of the shoulder portion 54 of the pin member 52 to the shoulder portion 48 of the body member 38.

Step #16, denoted by the reference numeral 116, is effected by turning the body member 38 through 180°, that is end-to-end, so that the second pin member 52 can be welded to the other end of the body member 38. Step #16 (116) is a repetition of step #15 (115), but with the second pin member 52 being attached.

The final product is a unitary sucker rod as indicated by the reference numeral 36 in FIG. 5. For all intents and purposes, it has the outward appearance of any other sucker rod. It is just that it is composed of three parts which have been inertia welded together to provide the composite and unitary end result embodied in the sucker rod 36.

I claim:

1. A composite sucker rod comprising a first member initially of one piece construction, said first member including a rod portion of one diameter, a bead portion, a wrench portion and a cylindrical portion of larger diameter than said rod portion, and a second member including a cylindrical portion and a threaded portion, said cylindrical portions having substantially the same diameter and being inertia welded to each other.

2. A composite sucker rod in accordance with claim 1 in which said members are of different material.

3. A composite sucker rod in accordance with claim 2 in which said first member is of carbon steel and said second member is of alloy steel.

4. A method of making a composite sucker rod comprising the steps of upsetting rod stock to form a first member with a cylindrical end portion thereto of larger cross section than that of the rod stock, machining a second member from additional stock to form a cylindrical end portion thereon, said additional rod stock having a cross section corresponding to that of the cylindrical end portion of said first member, inertia welding said end portions together, upsetting said first member at the other end thereof to form a second cylindrical end portion on said first member of larger diameter than that of said first-mentioned rod stock and corresponding to the cross section of said first-mentioned cylindrical end, machining a second member from still further stock to form a cylindrical end portion thereon, said still further rod stock having a cross section corresponding to that of the second cylindrical end portion of said first member and inertia welding said end portion of said third member to the second cylindrical portion of said first member.

5. A method of making a composite sucker rod in accordance with claim 4 in which said first member is of one type of steel and said second and third members are of a different type of steel.

6. A method of making a composite sucker rod in accordance with claim 5 in which said first member is of carbon steel and said second members are of alloy steel.

7. A method of making a composite sucker rod in accordance with claim 6 in which said second and third members constitute threaded pins.

8. A method of making a sucker rod comprising the steps of upsetting one end of a first section of rod stock to form a cylindrical slug thereon of larger diameter than that of said rod stock, upsetting said cylindrical slug to form a bead portion, a wrench portion and a cylindrical shoulder portion, forming a relatively smooth surface on the free end of said shoulder portion residing in a plane generally perpendicular to the longitudinal axis of said first rod stock, machining a second section of rod stock having a diameter corresponding to the diameter of said cylindrical shoulder portion to form a threaded portion, a neck portion and a cylindrical shoulder portion, forming a relatively smooth surface on the free end of said last-mentioned shoulder portion residing in a plane generally perpendicular to the longitudinal axis of said second rod stock, holding said first rod stock stationary, rotating said second rod stock, and advancing said second rod stock toward said first rod stock to inertia weld said free ends together.

9. A method of making a sucker rod in accordance with claim 8 in which said first rod stock is on the order of twenty-five feet in length and said second rod stock is on the order of two inches in length.

10. A method of making a sucker rod in accordance with claim 9 in which said first rod stock has a diameter on the order of five-eighths of an inch and said second rod stock has a diameter on the order of one and one-quarter inch.

* * * * *